United States Patent [19]

Hain et al.

[11] Patent Number: 4,623,081

[45] Date of Patent: Nov. 18, 1986

[54] BURSTER APPARATUS FOR CONTINUOUS FORMS

[75] Inventors: David A. Hain, Dundee; Ian J. Walker, Fife, both of Scotland

[73] Assignee: NCR Corporation, Dayton, Ohio

[21] Appl. No.: 793,862

[22] Filed: Nov. 1, 1985

[30] Foreign Application Priority Data

Jun. 26, 1985 [GB] United Kingdom ..... 8516154

[51] Int. Cl.[4] ..... B65H 35/10

[52] U.S. Cl. ..... 225/105; 225/5; 225/100; 225/106

[58] Field of Search ..... 225/100, 101, 106, 105, 225/5

[56] References Cited

U.S. PATENT DOCUMENTS

| | | | |
|---|---|---|---|
| 2,355,690 | 8/1944 | Zent | 225/100 |
| 2,618,336 | 11/1952 | Davidson | 225/5 |
| 4,261,497 | 4/1981 | Roetter et al. | 225/106 X |
| 4,401,249 | 8/1983 | Kadlecik et al. | 225/97 |

FOREIGN PATENT DOCUMENTS

| | | | |
|---|---|---|---|
| 648941 | 1/1951 | United Kingdom | 225/105 |
| 703237 | 2/1954 | United Kingdom . | |
| 703300 | 2/1954 | United Kingdom . | |
| 703301 | 2/1954 | United Kingdom . | |
| 1437207 | 5/1976 | United Kingdom . | |

*Primary Examiner*—Frank T. Yost

*Attorney, Agent, or Firm*—Wilbert Hawk, Jr.; Albert L. Sessler, Jr.; Elmer Wargo

[57] ABSTRACT

The invention relates to a burster apparatus (44) for separating into sheets a continuous form (22) which has transverse weakened lines and which is arranged to be conveyed along a feed path (43) through the apparatus. The apparatus includes a movable burster rod (82) which extends across the feed path, and a clamp member (96) operable to clamp the continuous form (22) with a weakened line aligned with the path of movement of the burster rod. By means of cams (70) and link members (92), the rod (82) is arranged to be moved through the feed path (43) while the form (22) is clamped, the rod being inclined relative to the feed path. During this movement, the rod (82) progressively bursts the form (22) along the aligned weakened line from one edge of the form to the other, thereby effecting a reliable bursting of the form even if the weakened line is improperly formed.

10 Claims, 12 Drawing Figures

BURSTER APPARATUS FOR CONTINUOUS FORMS

BACKGROUND OF THE INVENTION

This invention relates generally to burster apparatus for separating a continuous web into sheets, the separation taking place along transverse, weakened lines. The invention has particular application, for example, to burster apparatus for separating continuous stationery into suitable form sizes.

Prior art paper bursters commonly include a pair of high speed rollers and a pair of low speed rollers between which a paper web passes, the speed differential between the high speed and low speed rollers causing the web to become tightly stretched. The tension built up in the web causes the web to split along a weakened line. Web separation can be assisted by burster means such as a bar or blade positioned at a weakened line. Such a prior art arrangement is disclosed, for example, in U.S. Pat. No. 4,401,249.

In another prior art arrangement, disclosed for example in U.S. Pat. No. 1,437,207, a paper web is clamped on one side of a weakened line, and a bursting tension is applied to the web on the other side of the weakened line so as to bring about a separation of the web along this line.

Such prior art burster arrangements, which rely on the build-up of tension in continuous forms stationery in order to bring about separation along a weakened line, have the disadvantage that improper bursting or tearing of the forms may occur, particularly if the weakened lines are improperly formed.

SUMMARY OF THE INVENTION

It is an object of the present invention to provide a reliable burster apparatus which substantially overcomes the disadvantage referred to above.

According to a preferred embodiment of the invention there is provided a burster apparatus for separating into sheets a web which has transverse weakened lines formed thereon, comprising: conveying means for conveying said web along a feed path through said apparatus; an elongated burster member extending across said feed path and having first and second ends; mounting means for mounting said first and second ends of said elongated burster member for movement in a plane which is substantially perpendicular to said feed path at said predetermined position in said feed path; clamping means for clamping said web with one of said weakened lines being held in said predetermined position, and moving means for moving said clamping means between clamping and non-clamping positions; and actuating means for individually moving said first and second ends of said elongated burster member in said plane so as to move said elongated burster member at an angle to said feed path to progressively burst said web at said weakened line at said predetermined position when said clamping means is in said clamping position; said conveying means being effective to move a separated sheet from said web after said clamping means is moved to said non-clamping position.

Various advantages of this invention will become apparent from the following description, claims and drawing.

DETAILED DESCRIPTION OF THE INVENTION

Figure 1:
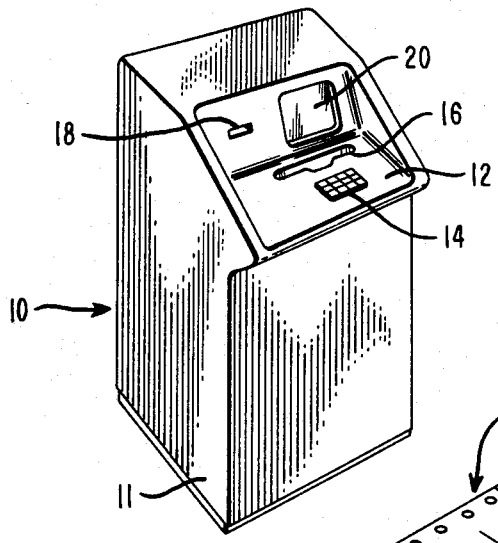
FIG. 1 is a perspective view of a self-service, financial terminal arranged to print and issue statements to bank customers.
Figure 2:
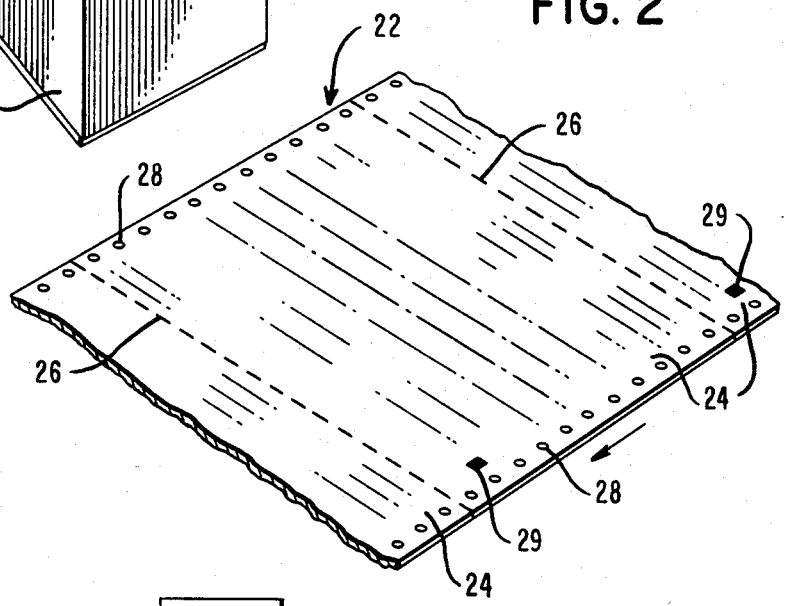
FIG. 2 is a perspective view of a portion of a continuous form used in the terminal of FIG. 1.

Referring to FIG. 1 of the drawing, the self-service, financial terminal 10 shown therein is intended to be free standing in the lobby of a bank and is arranged to provide printed statements on request to bank customers. The terminal 10 includes a housing 11 in an upper fascia portion 12 of which are provided a keyboard 14, a form exit slot 16, a card entry slot 18, and a display screen 20. In operation, a user inserts a customer identifying card into the slot 18 and then enters certain data such as his personal identification number upon the keyboard 14. Instructions to the user for operating the terminal 10 are displayed on the screen 20. In response to the data entered by the user, the terminal 10 prints account information on the leading portion of a continuous form 22 (FIG. 2) utilized in the terminal 10.

The continuous form 22, which has a width of 24 centimeters in the embodiment described, is separable into individual sheets (corresponding to successive portions 24 of the form 22) by bursting the form 22 along transverse weakened lines 26 such as lines of perforations. The form 22 is provided with equidistantly-spaced, sprocket holes 28 adjacent each edge, by means of which the form 22 can be moved in the direction indicated by the arrow. Also, each portion 24 carries a mark 29 (hereinafter referred to as a stop mark) adjacent to its leading end, the purpose of which will be described later. In response to data entered by a user on the keyboard 14, the terminal 10 prints account information on the leading portion 24 of the form 22, then separates this portion from the remainder of the form 22 by bursting the form 22 along the leading weakened line 26, and feeds the separated sheet to the user through the slot 16.

Figure 3:
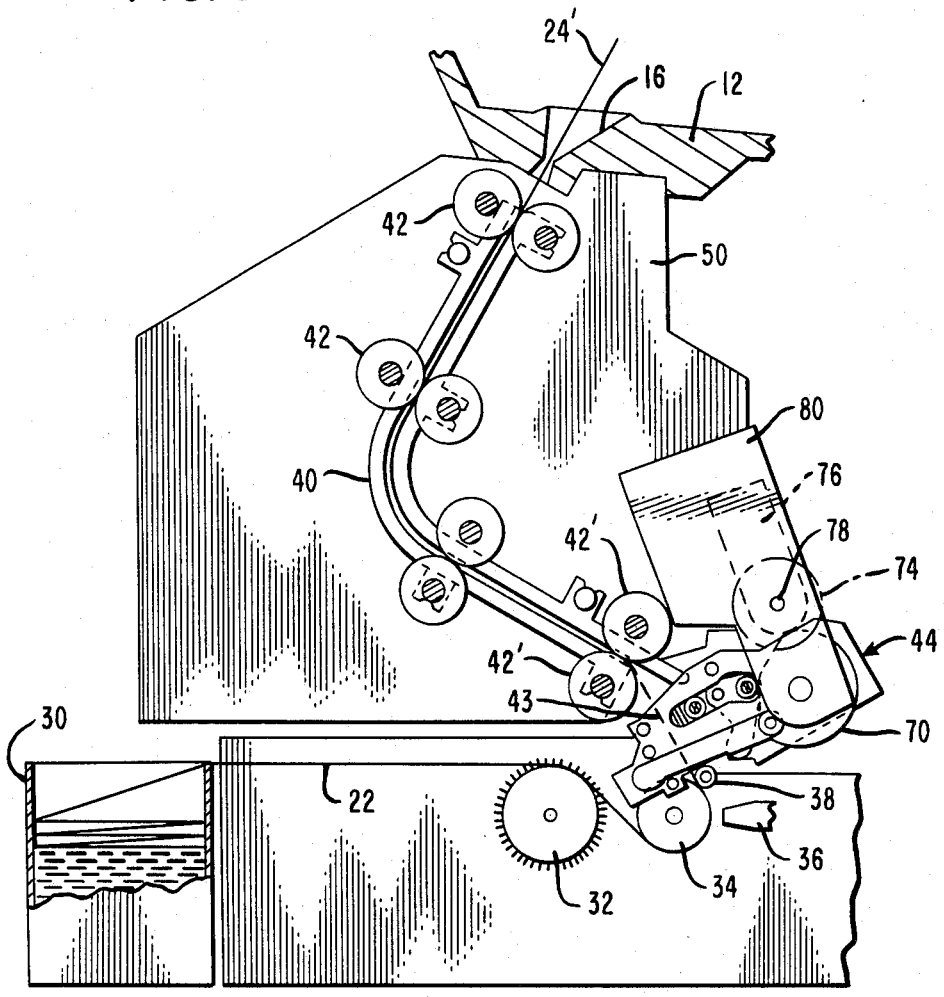
FIG. 3 is a schematic, side-elevational view of a paper burster apparatus and transport mechanism made according to this invention and incorporated in the terminal of FIG. 1.

Referring now to FIG. 3, the continuous form 22 is fed from a storage container 30 by a pair of sprocket wheels 32 which engage the sprocket holes 28 of the form 22, the form being stored in fan-folded form in the container 30. Downstream of the sprocket wheels 32, the form 22 passes partly around a cylindrical platen 34 which, together with a print head schematically indicated at 36, forms part of the printing mechanism of the terminal 10. The continuous form 22 is held against the surface of the platen 34 by a guide roller 38. In the course of a bursting operation, the leading end of the form 22 is fed into one end of an elongated guideway 40 where it is gripped by the first pair 42' of a series of continuously rotating friction drive rollers 42. Between the platen 34 and the pair of guide rollers 42', the form 22 extends along a feed path 43 through a burster apparatus 44 made according to this invention. The burster apparatus 44 is arranged to separate the first portion 24 of the form 22 from the remainder of the form 22 by bursting the form along the leading, weakened line 26 in a manner to be described hereinafter. Each separated sheet 24' is fed along the guideway 40 by the drive rollers 42 to the exit slot 16 formed in the fascia portion 12 where the sheet 24' can be collected by the user of the terminal 10.

The burster apparatus 44 will now be described with reference to FIGS. 4 to 10. Although, as shown in FIG. 3, the form 22 passes through the burster apparatus 44 at a substantial angle to the horizontal, for ease of description, the apparatus 44 is illustrated in FIGS. 4 to 10 and described with reference thereto on the basis that it has an orientation such that the form 22 passes through the apparatus along a horizontal path.

The apparatus 44 includes a support frame 46 (FIG. 4) having parallel vertical side plates 48 and 50 and a transverse plate 52. A support rod 54 and front and rear guide members 55 and 56 extend between, and are secured to, the side plates 48 and 50. When the leading end of the form 22 is being fed forwardly inside the burster apparatus 44, said end is guided into and along the feed path 43 by an upper portion 57 (FIG. 5) of the guide member 56 and by an inclined portion 58 and an upper, horizontal portion 59 of the guide member 55, said end being eventually gripped by the first pair 42' of the friction drive rollers 42. The upper portion 59 of the guide member 55 supports the form 22 while it extends through the burster apparatus 44.

Figure 4:
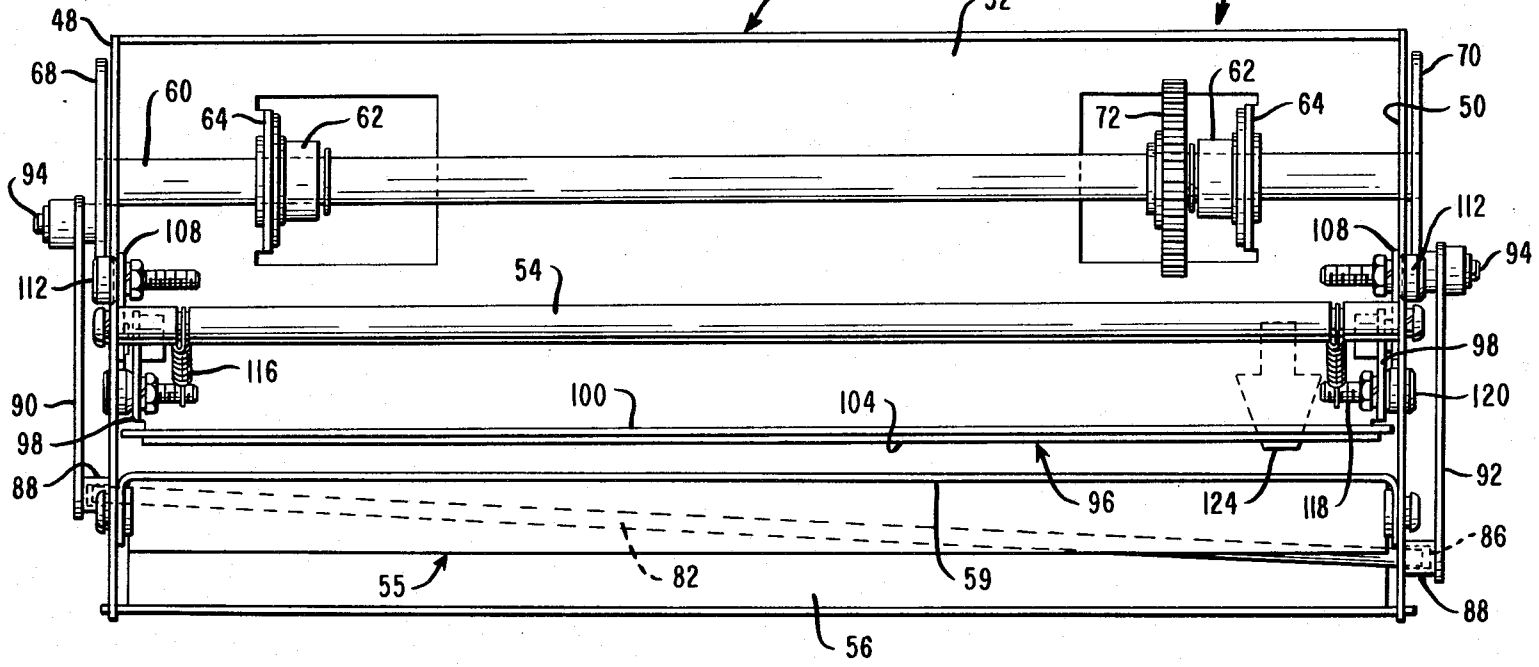
FIG. 4 is a front elevational view of the burster apparatus, shown in a non-operated condition.

A shaft 60 (FIG. 4) is rotatably mounted in two bearings 62 which are secured to flanges 64 formed integrally with the transverse plate 52. The end portions of the shaft 60 pass through openings 66 (FIG. 5) formed in the side plates 48 and 50, and a pair of identical cams 68 and 70 are respectively secured to the ends of the shaft 60, the cams 68 and 70 being respectively positioned adjacent the outer faces of the side plates 48 and 50 (FIG. 4). A gear wheel 72 is mounted on the shaft 60. The gear wheel 72 engages a gear wheel 74 (FIG. 5) arranged to be driven by means of a clutch 76 and drive shaft 78 mounted on a support frame 80 (FIG. 3). The drive shaft 78 is continuously driven by the drive means 79 (shown schematically) which serve to drive the rollers 42. The arrangement of the clutch 76, drive shaft 78 and gear wheels 72 and 74 is such that operation of the clutch 76 brings about a single complete revolution of the shaft 60 and cams 68 and 70 in the direction indicated by the arrows in FIGS. 6 to 8.

Figure 5:
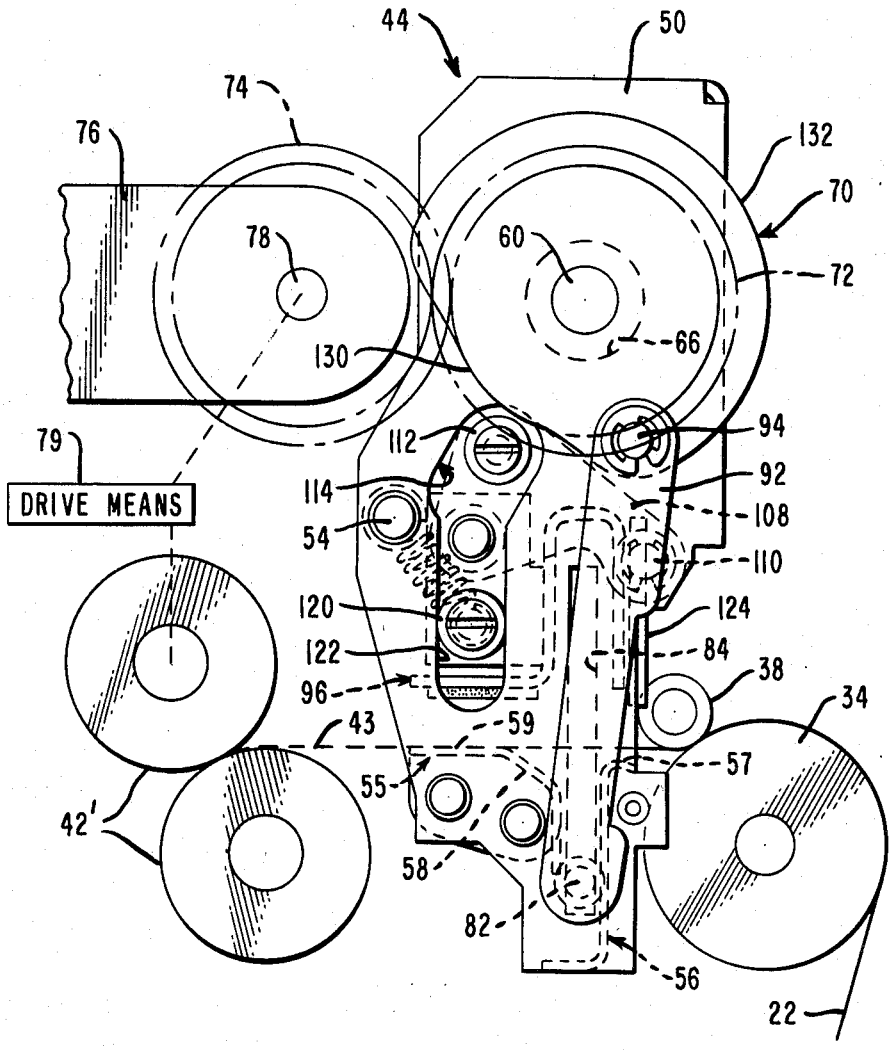
FIG. 5 is an enlarged, elevational view of the right hand side of the paper burster as seen in FIG. 4, together with part of the transport mechanism.
Figure 7:
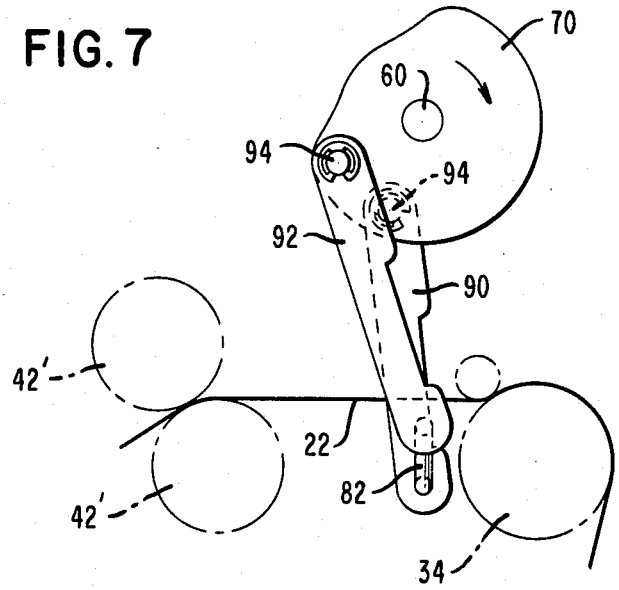
FIG. 7 is a schematic, side-elevational view of parts of the burster apparatus at a point in a cycle of operation of the apparatus immediately prior to the continuous form being burst.
Figure 8:
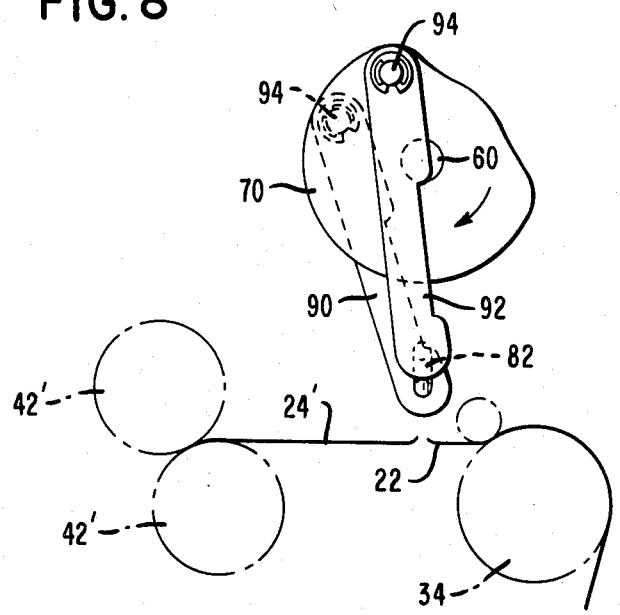
FIG. 8 is a view similar to FIG. 7, but showing the relevant parts of the burster apparatus immediately after the continuous form has been burst.
Figure 9:
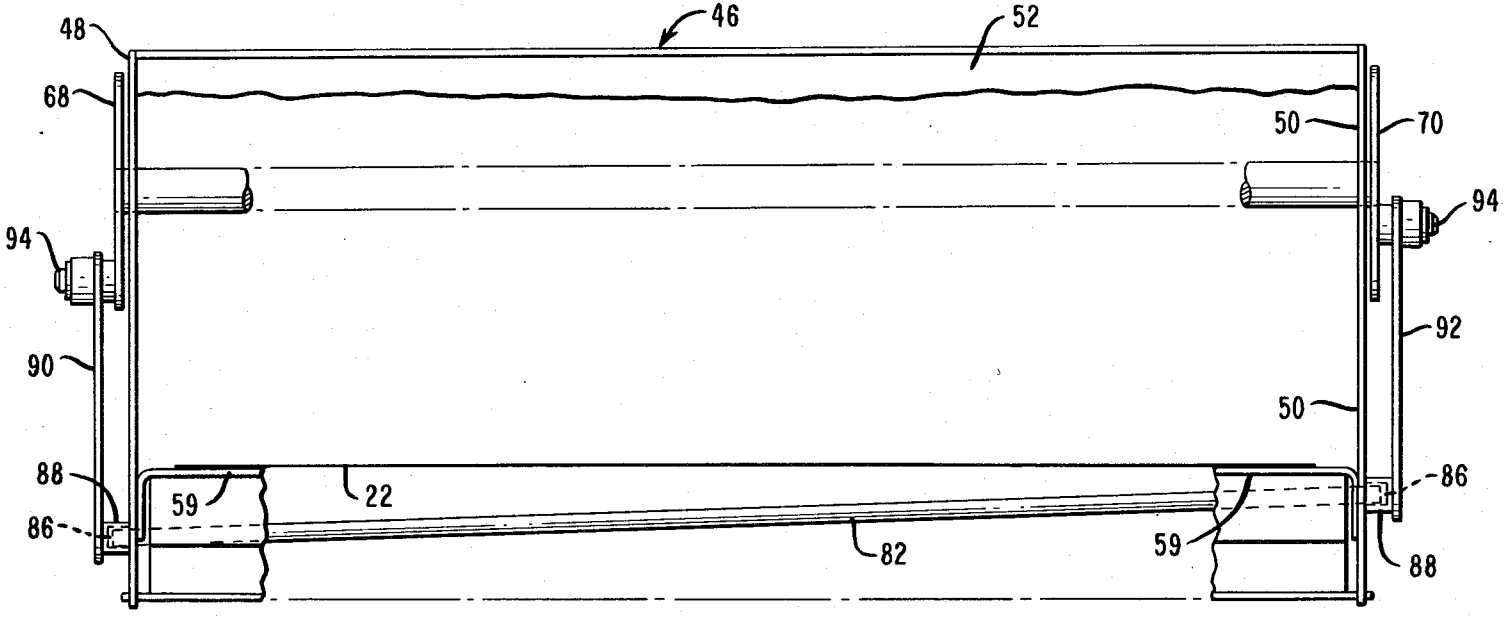
FIG. 9 is a front, elevational view of parts of the burster apparatus as shown in FIG. 7, and additionally shows part of the supporting framework.
Figure 10:
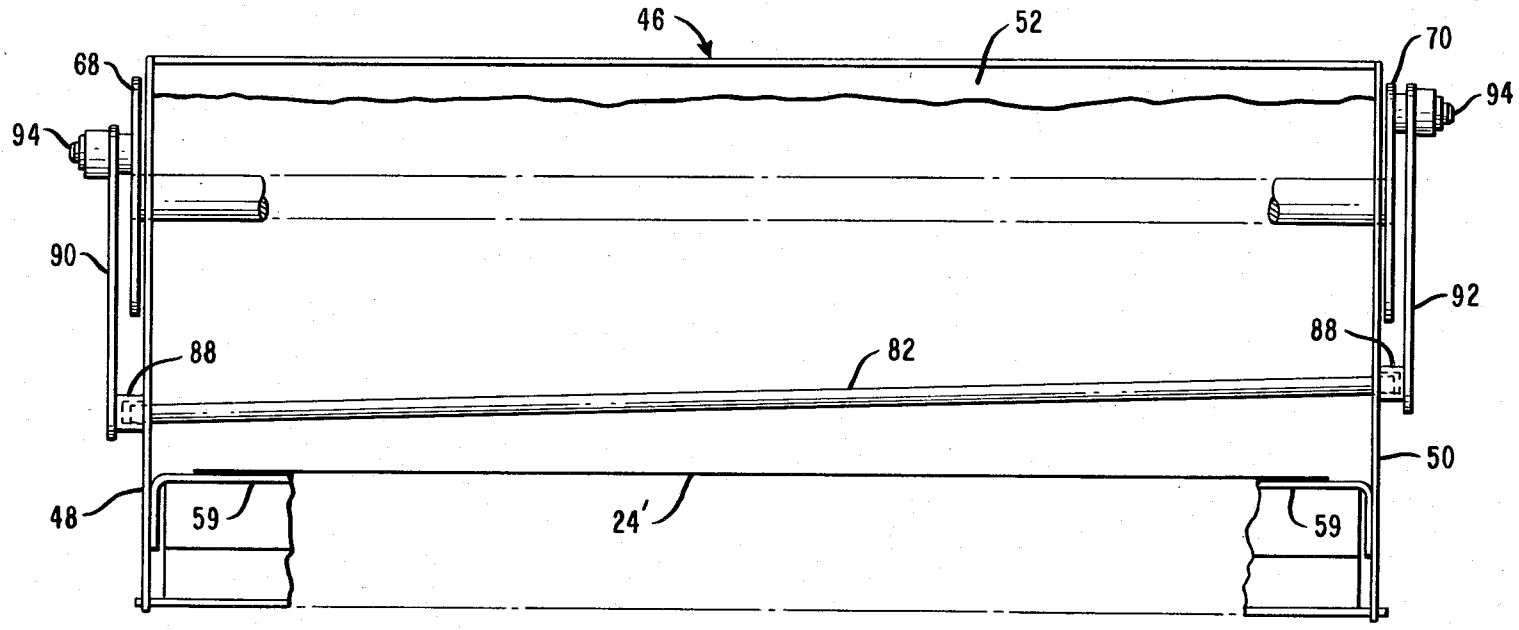
FIG. 10 is a front, elevational view of parts of the burster apparatus as shown in FIG. 8, and additionally shows part of the supporting framework.

A rigid metal burster rod 82 (best shown in FIG. 9), which has a straight axis and constant circular cross-section and which typically has a diameter of about 3 millimeters in the embodiment described, extends across the gap between the side plates 48 and 50, the end portions of the rod 82 passing through and being slidably mounted in two vertically extending slots 84 (FIG. 6), formed in the side plates 48 and 50, respectively. Each end of the rod 82 is slidably supported in a cylindrical recess 86 (FIG. 4) formed in a respective support member 88. The support members 88 are respectively mounted on two generally vertically extending link members 90 and 92 (FIG. 4) adjacent the lower ends thereof. The upper ends of the link members 90 and 92 are rotatably mounted, respectively, on two support studs 94 which are each mounted on a respective one of the cams 68 and 70. As is seen in FIGS. 7 and 8, the positions at which the studs 94 are attached to the cams 68 and 70 are angularly displaced from each other relative to the axis of the shaft 60. Due to this angular displacement, when the cams 68 and 70 are in their rest position as shown in FIGS. 4 and 5, the burster rod 82 is disposed at an angle to the horizontal with its left hand end (with respect to FIG. 4) higher than its right hand end. During a revolution of the cams 68 and 70, the burster rod 82 changes its angular disposition to the horizontal, the rod 82 first passing through a horizontal position to a position (as seen in FIGS. 9 and 10) in which its left hand end is lower than its right hand end, and then passing back through a horizontal position to the position shown in FIG. 4. It will be appreciated that such change in angular disposition is made possible by virtue of the fact that the ends of the burster rod 82 are slidably supported in the recesses 86 in the support members 88.

Figure 6:
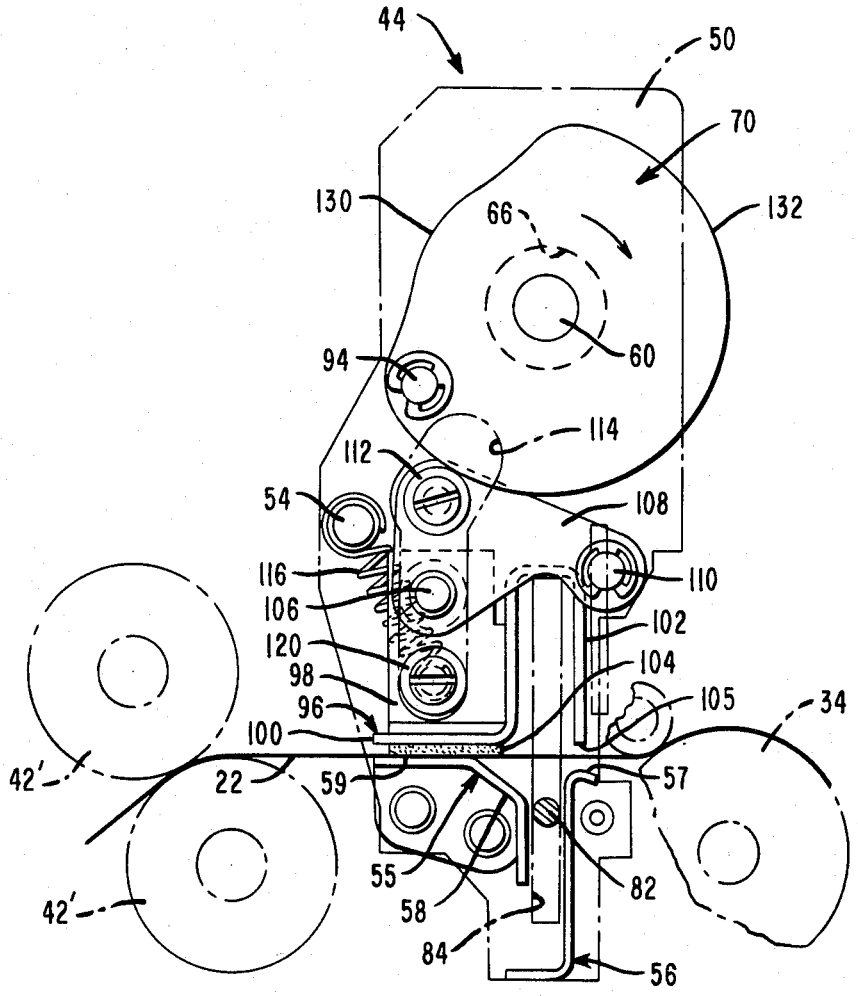
FIG. 6 is a view similar to FIG. 5, but with certain parts omitted and with a clamping means included in the burster apparatus which is shown in a clamping position.

The burster apparatus 44 also includes a clamp member 96 which is vertically movable between an upper, non-clamping position as seen in FIGS. 4 and 5 and a lowermost clamping position as seen in FIG. 6. The clamp member 96 comprises side support portions 98, a front, lower horizontal portion 100, and a rear, inverted U-shaped portion 102 (FIG. 6) which is integral with the portion 100. The lower face of the horizontal portion 100 is provided with a layer 104 of elastomeric material, and the free end 105 (FIG. 6) of the U-shaped portion 102 is positioned in substantially the same horizontal plane as the lower face of the horizontal portion 100. When the clamp member 96 is in its clamping position, the form 22 is firmly clamped between the layer 104 and the upper horizontal portion 59 (FIG. 6) of the guide member 55. The portions 100 and 102 and the layer 104 extend across substantially the whole of the gap between the side plates 48 and 50. Each support portion 98 (FIGS. 4–6) is pivotally mounted on a stud 106 mounted on a respective cam arm 108, the cam arms 108 being respectively associated with the cams 68 and 70. Each cam arm 108 is pivotally mounted on a stud 110 secured to the adjacent one of the side plates 48 and 50, and each cam arm 108 carries a follower roller 112 which bears against the periphery of the associated cam 68 or 70, each follower roller 112 passing through a slot 114 (FIGS. 5 and 6) formed in the adjacent side plate 48 or 50. The follower rollers 112 are held in engagement with the cams 68 and 70 by means of respective tension springs 116. One end of each spring 116 is connected to the support rod 54, the other end of the spring 116 being connected to the adjacent support portion 98 of the clamp member 96 by means of a stud 118 (FIG. 4). Each support portion 98 has secured thereto a guide stud 120 which is a sliding fit in a vertically extending portion 122 (FIG. 5) of the slot 114 formed in the adjacent side plate 48 or 50. During a revolution of the cams 68 and 70, the follower rollers 112 bring about a pivoting or rocking movement of the cam arms 108 about the studs 110. By virtue of the connection of the support portions 98 of the clamp member 96 to the cam arms 108 and by virtue of the sliding engagement of the guide studs 120 in the vertical slot portions 122, the rocking movement of the cam arms 108 brings about a movement of the clamp member 96 towards and away from the upper portion 59 (FIG. 5) of the guide member 55 in a direction substantially normal to said portion 59.

A vertically extending optical sensing device 124 (FIGS. 4 and 5) is secured to the transverse plate 52 adjacent the side plate 50. The lower, sensing end of the device 124 is positioned a short distance above the feed path 43 for the form 22, and, in operation, as the leading portion 24 of the form 22 passes through the burster apparatus 44, the device 124 is arranged to sense the stop mark 29 (FIG. 2) carried by the next succeeding portion 24.

Figure 11:
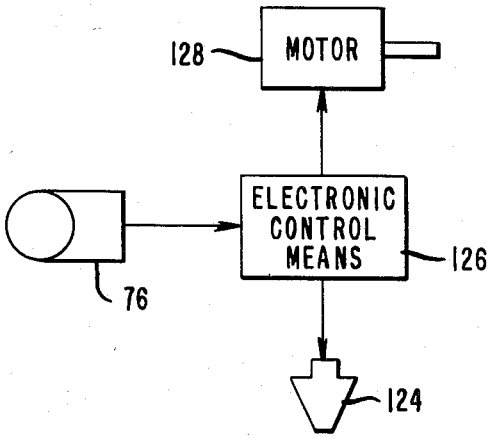
FIG. 11 is a schematic block diagram illustrating the electrical interconnections of parts of the burster apparatus and transport mechanism.

Referring now to FIG. 11, the financial terminal includes electronic control means 126 connected to the clutch 76, to the optical sensing device 124, and to an electric motor 128 arranged to drive the sprocket wheels 32 and platen 34. In response to the sensing by the sensing device 124 of a stop mark 29 on the form 22, the control means 126 is arranged to stop the motor 128 and to operate the clutch 76 so as to bring about a single revolution of the cams 68 and 70.

The operation of the burster apparatus 44 and associated parts of the financial terminal will now be described. Immediately prior to a customer requesting a statement from the terminal 10, the burster apparatus 44 is in a rest (non-operated) condition as shown in FIGS. 4 and 5, and the sprocket wheels 32 and platen 34 are stationary. With the burster apparatus 44 in its rest condition, the leading edge of the form 22 is positioned in a plane containing the longitudinal axes of the slots 84, the burster rod 82 is positioned on that side of the feed path 43 remote from the clamp member 96, the clamp member 96 is in a non-clamping position furthermost from the guide member 55, and the cams 68 and 70 are stationary, with each follower roller 112 being held in engagement with a low portion 130 of the respective cam 68 or 70.

Upon a user initiating a statement printing operation by inserting his customer identifying card in the slot 18 and entering appropriate data upon the keyboard 14, the motor 128 is energized so as to cause the sprocket wheels 32 and platen 34 to drive the form 22 past the print head (FIG. 3), the print head 36 being arranged to print account information on the leading portion 24 of the form 22. As the form 22 is fed past the print head 36, the leading edge of the form 22 is guided by the guide members 55 and 56 into and along the feed path 43, this edge being eventually gripped by the continuously rotating drive rollers 42'. After the print head 36 has completed its printing operation, the leading portion 24 of the form 22 continues to be fed through the burster apparatus 44 until the sensing device 124 senses the stop mark 29 carried by the next succeeding portion 24 of the form 22. Thereupon, the sensing device 124 outputs a stop signal to the control means 126 which deenergizes the motor 128 so as to stop the movement of the form 22 along the feed path, the stationary sprocket wheels 32 acting as a brake on the form 22. The stop marks 29 on the form 22 are so positioned that the form 22 is stopped with the leading weakened line 26 positioned in the path of movement of the burster rod 82, that is to say immediately above the burster rod 82 with reference to FIGS. 5 and 6.

Immediately following the stopping of the form 22, the control means 126 applies an energizing signal to the clutch 76 so as to operate the clutch 76 and thereby bring about a single complete revolution of the cams 68 and 70. During a first part of the revolution of the cams 68 and 70, the follower rollers 112 move from the low portions 130 of the cams 68 and 70 on to high portions 132 thereof. The clamp member 96 is thereby caused to move from the non-clamping position shown in FIG. 5 to the clamping position shown in FIG. 6, the guide studs 120 sliding along the slot portions 122 in the side plates 48 and 50. With the clamp member 96 in its clamping position, the leading portion 24 of the form 22 is firmly gripped between the elastomeric layer 104 of the clamp member 96 and the portion 59 of the guide member 55. The leading portion 24 of the form 22 is gripped in a region adjacent the leading weakened line 26, and the end 105 of the clamp member 96 is positioned a short distance from the form 22 and adjacent the leading weakened line 26, the end 105 and the layer 104 being positioned on opposite sides of this line 26. By virtue of the clamping action of the clamp member 96 and the engagement of the form 22 by the stationary sprocket wheels 32, the portion of the form 22 extending between the clamp member 96 and the platen 34 is held in a taut condition.

During this first part of the revolution of the cams 68 and 70, the clamp member 96 is moved into its clamping position, and the burster rod 82 remains on that side of the feed path 43 remote from the clamp member 96, however, it changes from an orientation in which its left hand end is higher than its right hand end (with reference to FIG. 4) to an orientation in which its right hand end is higher than its left hand end (as shown in FIGS. 9 and 10). Referring now particularly to FIGS. 7 to 10, during a second part of the revolution of the cams 68 and 70 the form 22 remains clamped as described above and a bursting movement of the burster rod 82 is brought about by the link members 90 and 92. These link members 90 and 92 raise the rod 82 from the position shown in FIGS. 7 and 9 in which it is below the feed path 43 to the position shown in FIGS. 8 and 10 in which it is above the feed path; during this bursting movement, the burster rod 82 is inclined relative to the feed path 43, the right hand end of the rod (with reference to FIGS. 9 and 10) remaining higher than the left hand end. In the course of the bursting movement of the burster rod 82, the rod 82 first contacts the right hand end (with reference to FIGS. 9 and 10) of the leading weakened line 26 and then progressively bursts the form 22 along this line 26 from the right hand edge of the form 22 to its left hand edge. Thus, at the completion of this second part of the revolution of the cams 68 and 70, the leading portion 24 of the form 22 is completely separated from the remainder of the form 22 so as to form a separated sheet 24', as seen in FIG. 8. It should be understood that, during this bursting movement of the rod 82, the end 105 of the clamp member 96 serves to prevent any substantial upward movement of the form 22.

During the remaining part of the revolution of the cams 68 and 70, the follower rollers 112 move back on to the low portions 130 of the cams 68 and 70, thereby causing the clamp member 96 to be returned under the action of the springs 116 to its non-clamping position shown in FIGS. 4 and 5. At the same time, the burster rod 82 returns to its rest position below the feed path 43, again as shown in FIGS. 4 and 5. Immediately after the clamp member 96 moves away from its clamping position, the separated sheet 24' is fed by the continuously rotating friction drive rollers 42 along the guideway 40 to the position shown in FIG. 3 where this sheet 24' is available for collection by the user of the financial terminal 10.

Figure 12:
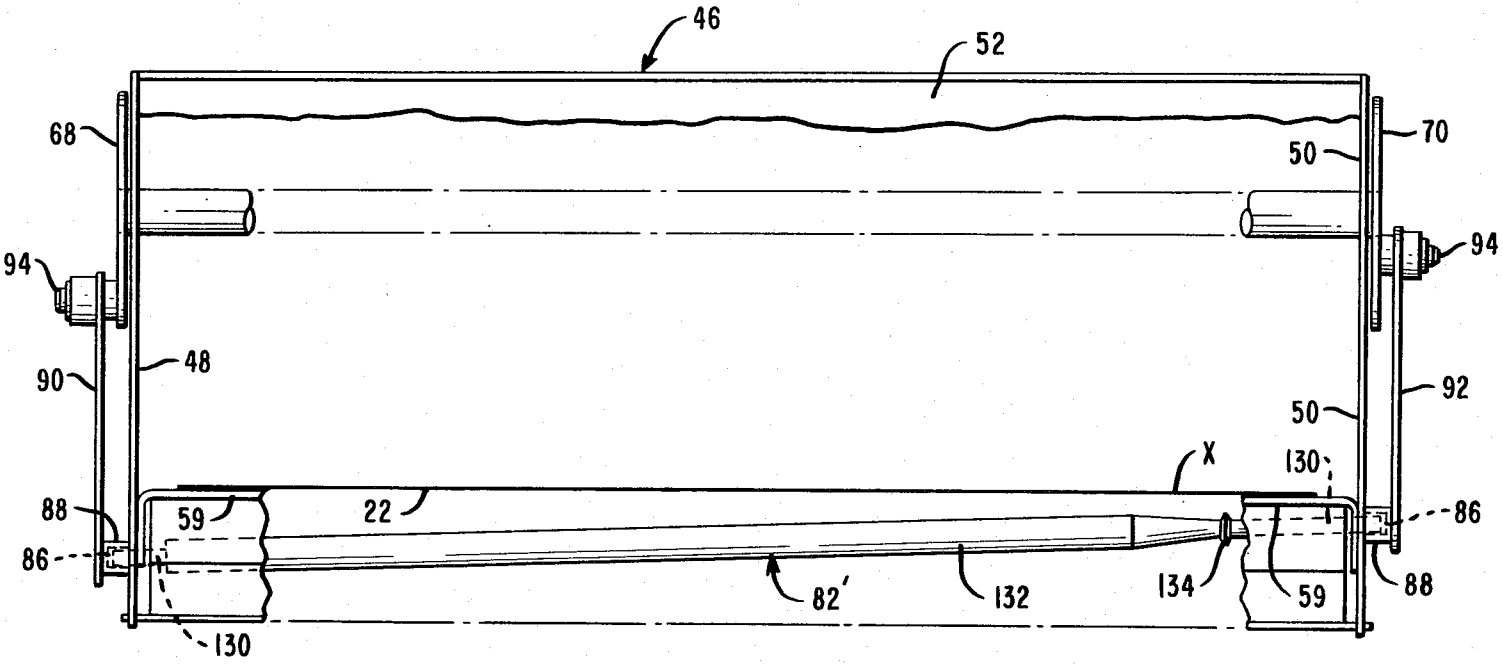
FIG. 12 is a view similar to FIG. 9, but shows a modified burster member.

Referring now to FIG. 12, there is shown therein a modified burster rod 82'. The burster rod 82' is slidably supported at its ends in the recesses 86 in the support members 88 in the same manner as is the burster rod 82. The modified burster rod 82' has a straight axis but it differs from the rod 82 in that it has a non-uniform cross-section. Thus, the rod 82' includes end portions 130 having the same diameter as the rod 82, and a main portion 132 of wider diameter, typically 6 millimeters, which tapers at one end (the right hand end with reference to FIG. 12) to a bevelled portion 134. The bevelled portion 134 adjoins the right hand end portion 130 and has a maximum diameter substantially equal to the diameter of the main portion 132.

During a bursting movement of the rod 82', the first part of the rod 82' to contact the form 22 is the bevelled portion 134. The portion 134 contacts the leading weakened line 26 at a location, indicated by the reference "X" in FIG. 12, which location is about 1.5 centimeters from the right hand edge (with reference to FIG. 12) of the form 22. Bursting of the form 22 commences at this location, and thereafter, the rod 82' progressively bursts the form 22 from this location towards both edges of the form 22 until a complete separation of the leading portion 24 of the form 22 has been effected. It is found that the use of the modified rod 82' is particularly advantageous in achieving satisfactory bursting of a continuous form in the case where the weakened lines are formed by lines of perforations in which there is a substantial distance from each edge of the form to the first perforation from that edge.

In a further modification of the burster apparatus 44 described above, the burster rod 82 could be replaced by a wire arranged to be stretched tautly between the link members 90 and 92 during a bursting movement of the wire through the feed path 43.

The burster apparatus 44 described above with reference to the accompanying drawing effects a reliable and correct bursting of the continuous form 22 along the leading weakened line 26, and it is found that effective bursting is achievable even in the event of this line being improperly formed. Moreover, this burster apparatus has the additional advantages that it is of low cost and has a compact form of construction.

What is claimed is:

1. A burster apparatus for separating into sheets a web which has transverse weakened lines formed thereon, comprising:

conveying means for conveying said web along a feed path through said apparatus;

an elongated burster member extending across said feed path and having first and second ends;

mounting means for mounting said first and second ends of said elongated burster member for movement in a plane which is substantially perpendicular to said feed path at a predetermined position in said feed path;

clamping means for clamping said web with one of said weakened lines being held in said predetermined position;

moving means for moving said clamping means between clamping and non-clamping positions; and actuating means for individually moving said first and second ends of said elongated burster member in said plane so as to move said elongated burster member at an angle to said feed path to progressively burst said web at said weakened line at said predetermined position when said clamping means is in said clamping position;

said conveying means being effective to move a separated sheet from said web after said clamping means is moved to said non-clamping position.

2. The burster apparatus as claimed in claim 1 in which said elongated burster member comprises a rigid rod.

3. The burster apparatus as claimed in claim 2 in which said rigid rod has an axis.

4. The buster apparatus as claimed in claim 2 in which said elongated burster member has a configuration which enables a portion of said elongated burster member to contact said web at a location between the center of said web and one edge thereof.

5. The burster apparatus as claimed in 2 in which said actuating means includes cam means including first and second cams to progressively burst said web, said cam means also including first and second links coupled respectively between said first and second ends of said burster member and said first and second cams to move said elongated burster member at said angle as said cam means is rotated.

6. The burster apparatus as claimed in claim 5 in which said actuating means includes means for coupling said moving means with said cam means so as to move said clamping means between said clamping and non-clamping positions in response to the rotation of said cam means.

7. The burster apparatus as claimed in claim 6 in which said web has a plurality of stop marks thereon for use in aligning a said transverse weakened line at said predetermined position, and in which said conveying means includes a sensing means which is positioned in said burster apparatus for producing an output upon sensing a said stop mark, said output being used by said conveying means to align a said transverse weakened line at said predetermined position.

8. The burster apparatus as claimed in claim 7 in which said actuating means includes a clutch means for rotating said cam means through one revolution to progressively burst said web in response to said output from said sensing means.

9. The burster apparatus as claimed in claim 8 in which said clamping means includes a clamp which is positioned adjacent to and upstream from a said weakened line when said clamping means is in said clamping position.

10. The burster apparatus as claimed in claim 9 in which said clamp has a face with elastomeric material thereon to engage said web when said clamping means is in said clamping position.

* * * * *